US005414896A

United States Patent [19]

Domenig

[11] Patent Number: 5,414,896

[45] Date of Patent: May 16, 1995

[54] ADJUSTABLE DOOR HINGE

[75] Inventor: Georg Domenig, Kernersville, N.C.

[73] Assignee: Grass America, Inc., Kernersville, N.C.

[21] Appl. No.: 36,061

[22] Filed: Mar. 23, 1993

[51] Int. Cl.[6] ..... E05D 7/04

[52] U.S. Cl. ..... 16/248; 16/237

[58] Field of Search ..... 16/237, 236, 248

[56] References Cited

U.S. PATENT DOCUMENTS 3,908,226 9/1975 Read et al. ..... 16/237

5,067,200 11/1991 Stowell et al. ..... 16/237

*Primary Examiner*—P. Austin Bradley

*Assistant Examiner*—Chuck Y. Mah

[57] ABSTRACT

An adjustable door hinge for mounting a door on a supporting frame utilizing a hinge arm receiver and a hinge plate connected by hinge arm having ends that are pivotally connected to the hinge arm receiver and the hinge place. The hinge plate has a depending edge fashioned to be cooperatively received by a groove formed in the frame to provide additional gripping strength and hinge stability.

4 Claims, 1 Drawing Sheet

ADJUSTABLE DOOR HINGE

BACKGROUND OF THE INVENTION

1. Field of the Invention

The present invention relates to adjustable hinges and more particularly to a stabilizing feature for the hinge plate of an adjustable hinge.

2. Description of the Prior Art

Adjustable hinges are known in the art and are affixed to either a door or a supporting frame by a variety of devices. In many instances, a single screw is sufficient to stabilize the hinge plate against either the door or supporting frame, however, in other situations where additional strength is necessary, some other element is needed to provide additional stability.

In my U.S. patent application Ser. No. 809,296 directed to an adjustable recessed door hinge, I have provided a substantially U-shaped hinge plate so that both sides of the supporting frame is gripped by portions of the hinge plate. Such a design does provide additional stability, however, even greater stability is needed under some circumstances. The present invention has been developed to provide that additional stability.

OBJECTIVES AND SUMMARY OF INVENTION

The present invention overcomes the problems associated with prior art devices and provides an adjustable hinge for mounting a door on a supporting frame which is simple and inexpensive to make and easy to install and use.

Another advantage and objective of the present invention is to provide an adjustable hinge that has all of the advantages of prior art devices and none of the disadvantages.

Yet another objective of the present invention is to provide an adjustable hinge that has exceptional supporting capability associated with the hinge plate.

To achieve these objectives in accordance with the invention, an adjustable hinge for mounting a door on a supporting frame is provided and includes a hinge arm receiver affixed to either the frame or door, a hinge plate affixed to the other of the frame or door, and a hinge arm connecting the receiver and plate. The hinge plate has side legs that grip either side of the door or frame and a depending edge extending from one of its legs that is cooperatively received by a groove formed in the door or frame.

Thus there has been outlined the more important features of the invention in order that the detailed description that follows may be better understood and in order that the present contributions to the art may be better appreciated. There are additional features of the invention that will be described hereinafter and which will form the subject matter of the claims appended here to. In this respect, before explaining one embodiment of the invention in detail, it is to be understood that the invention is not limited in its application to the arrangement of the components set forth in the following description or illustrated in the drawings. The invention is capable of other embodiments and of being practiced and carried out in various ways.

It is also to be understood that the terminology employed herein is for the purpose of description and should not be regarded as limiting. As such, those skilled in the art will appreciate that the concept from which this disclosure is based may readily be utilized as a basis for designing other structures, and methods in carrying out the several purposes of the invention. It is important that the claims be regarded as including such equivalent methods and products resulting therefrom so long as they do not depart from the spirit and scope of the present invention. The application is neither intended to define the invention which is measured by its claims, nor to limit its scope in any way.

DETAILED DESCRIPTION OF THE PREFERRED EMBODIMENT

Figure 1:
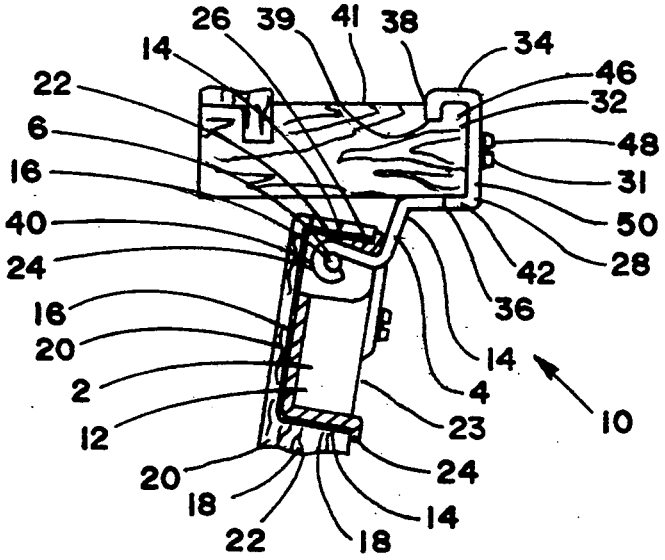
FIG. 1 is a side elevational, sectional, and fragmentary view of a hinge embodying the invention mounted on a door in connection with a supporting frame with the hinge in the open position.
Figure 3:
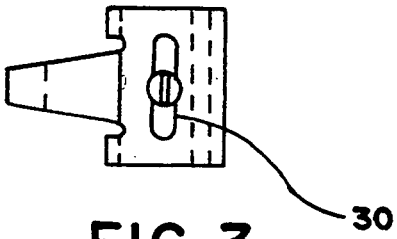
FIG. 3 is a plan view of the hinge arm and hinge plate shown in FIG. 2 embodying the present invention.
Figure 2:
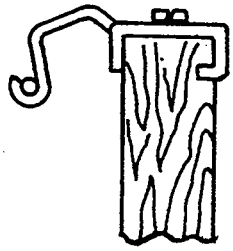
FIG. 2 is a side elevational, sectional, and fragmentary view of the hinge arm shown in FIG. 1 without the hinge cup.
Figure 5:
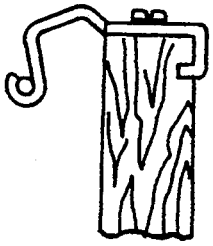
FIG. 5 is a side elevational view of another embodiment of the hinge plate including the present inventive concept.
Figure 4:
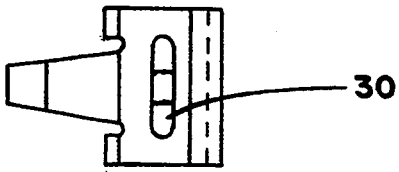
FIG. 4 is a bottom view of the hinge arm and hinge plate shown in FIGS. 2 and 3.

Referring now to the drawings and particularly to FIG. 1, the adjustable hinge shown generally as 10 in this example includes a hinge cup 12 to which a hinge arm 14 is connected. Hinge arm 14 is pivoted on a hinge pin 16, and hinge cup 12 is inserted into a bore defined by a substantially circular interior wall 18 and bottom 20 on the inside or back 23 of door 22.

Hinge arm 14 is pivoted at end 24 on hinge pin 16, and hinge plate 28 is formed integrally on the opposing end of hinge arm 14. Hinge plate 28 is provided with at least one slotted hole having a longitudinal axis which extends parallel to the pivot axis of hinge pin 16. Hinge plate 28 is secured to supporting frame 32 through slotted hole 30 by a screw inserted into supporting frame 32. Hinge plate 28 is provided with legs 34, 36 that form essentially a U-shaped member to encompass the end and sides of frame 32. In addition, leg 34 is provided with a depending edge 38 which is received in a groove 39 formed in the back 41 of supporting frame 32. Displacement or repositioning of the door member 18 relative to supporting frame 32 in a direction parallel to the pivot axis of hinge pin 16 can be accomplished by loosening and fastening screw 31.

The use of edge 38 on leg 34 of hinge plate 28 provides exceptionally reliable stability for the hinge and minimizes the need to subsequently adjust the pivotal movement of the door with respect to the frame. The edge can be used with hinge cups and bore holes as well as surface mounted hinge components with equal effectiveness and efficiency.

With respect to the present inventive concept, it is to be realized that the techniques involved in forming the novel combination set forth herein the components associated therewith are in unlimited and are deemed readily apparent and obvious to one skilled in the art. All equivalent relationships to those illustrated in those drawings described in the specification are intended to be encompassed herein.

The following is considered as illustrative only of the principals of the invention. Since numerous modifications and changes were readily occurred with those skilled in the art, it is not desired to limit the invention to the exact instruction and operation shown and described. All suitable modifications and equivalence falling within the appended claims are deemed within the present inventive concept.

What is claimed is:

1. An adjustable hinge for mounting a door member on a supporting frame, the door member and the supporting frame each having a back, either the door member or the supporting frame having a ledge receiving groove and one of which is provided with a hinge arm receiver, the hinge comprising: a hinge arm having first and second ends, the first end connected to the hinge arm receiver and the second end having a hinge plate first portion affixed to and spanning the thickness of either the door member or the supporting frame, a second portion perpendicular to the first portion running parallel to and contiguous with the back of either of the door member or the supporting frame, and a third portion parallel to the first portion, perpendicular to the second portion and cooperatively received by the door or frame receiving groove.

2. The hinge as claimed in claim 1 wherein the hinge arm receiver is adapted for displacement relative to the other of the door and supporting frame in a direction parallel to a pivot access of the hinge arm.

3. The hinge is claimed in claim 2 wherein the hinge plate includes portions defining at least one slotted hole adapted to receive a fastening screw therethrough, the slotted hole having individual axis parallel to the pivot axis of the hinge arm and adapted to guide displacement of the hinge plate.

4. The hinge as claimed in claim 1 wherein the hinge plate includes a portion defining at least one slotted hole adapted to receive a fastening screw therethrough, the slotted hole having an axis parallel to a pivot axis of the hinge arm and adapted to guide displacement of the hinge plate.

* * * * *